US007481848B2

(12) United States Patent
Nakazaki et al.

(10) Patent No.: US 7,481,848 B2
(45) Date of Patent: Jan. 27, 2009

(54) METHOD FOR COLORING CELLULOSE FIBER AND COLORED CELLULOSE FIBER OBTAINED THEREBY

(75) Inventors: Masahiro Nakazaki, Neyagawa (JP); Kunihiro Ohshima, Neyagawa (JP); Susumu Katsuen, Osaka (JP); Atsushi Igami, Osaka (JP)

(73) Assignee: Kurashiki Boseki Kabushiki Kaisha, Okayama (JP)

( * ) Notice: Subject to any disclaimer, the term of this patent is extended or adjusted under 35 U.S.C. 154(b) by 0 days.

(21) Appl. No.: 10/551,962

(22) PCT Filed: Nov. 8, 2004

(86) PCT No.: PCT/JP2004/016543

§ 371 (c)(1),
(2), (4) Date: Sep. 5, 2006

(87) PCT Pub. No.: WO2005/047592

PCT Pub. Date: May 26, 2005

(65) Prior Publication Data

US 2007/0033741 A1 Feb. 15, 2007

(30) Foreign Application Priority Data

Nov. 12, 2003 (JP) ..... 2003-382354

(51) Int. Cl.
*D06M 13/192* (2006.01)

(52) U.S. Cl. ..... 8/594; 8/115.51; 8/557; 8/588; 8/595; 8/608

(58) Field of Classification Search ..... 8/115.51, 8/594, 588, 595, 608, 557
See application file for complete search history.

(56) References Cited

U.S. PATENT DOCUMENTS

| | | | | | |
|---|---|---|---|---|---|
| 2,210,267 | A | * | 8/1940 | Smith | 132/73.6 |
| 4,371,517 | A | * | 2/1983 | Vanlerberghe et al. | 424/70.13 |
| 5,212,040 | A | * | 5/1993 | Sanders et al. | 430/125.3 |
| 5,316,850 | A | * | 5/1994 | Sargent et al. | 428/378 |
| 6,371,993 | B1 | * | 4/2002 | Moeller et al. | 8/407 |
| 6,790,239 | B1 | * | 9/2004 | Moeller et al. | 8/405 |
| 2005/0210600 | A1 | * | 9/2005 | Collier et al. | 8/115.51 |

FOREIGN PATENT DOCUMENTS

| | | | | |
|---|---|---|---|---|
| CN | 11079616 | A | | 9/1995 |
| JP | 53-143786 | A | | 12/1978 |
| JP | 54-30986 | A | | 3/1979 |
| JP | 58-45401 | B2 | | 10/1983 |
| JP | 2000-143683 | A | | 5/2000 |
| JP | 2001-55672 | A | | 2/2001 |
| WO | 99/18916 | | * | 4/1999 |
| WO | 01/34106 | | * | 5/2001 |

OTHER PUBLICATIONS

Zhi-cheng YU et al.; Journal of Functional Polymers; vol. 15, No. 4; Study on the Preparation, Structure and the Properties of the Deodorizing and Antibacterial Cellulose Fiber; pp. 461-465; Dec. 31, 2002.

* cited by examiner

*Primary Examiner*—Lorna M Douyon
*Assistant Examiner*—Amina Khan
(74) *Attorney, Agent, or Firm*—Birch, Stewart, Kolasch & Birch, LLP

(57) ABSTRACT

A method for producing a colored cellulose fiber, comprising:

a step (1) of introducing a carboxylic group or a sulfonic acid group into cellulose fiber, and a step (2) of treating the cellulose fiber having the carboxylic group or the sulfonic acid group introduced with an aromatic derivative having one or more hydroxyl groups and a metal salt simultaneously or separately, and a colored cellulose fiber produced by the same method.

13 Claims, No Drawings

METHOD FOR COLORING CELLULOSE FIBER AND COLORED CELLULOSE FIBER OBTAINED THEREBY

TECHNICAL FIELD

The present invention relates to a method for coloring a cellulose fiber and a colored cellulose fiber produced thereby.

PRIOR ART

Conventionally, a coloring method using plant dyes has been known as a method for dyeing fibers. The coloring method using plant dyes is a method for dyeing fibers by using an extract (pigment or the like) extracted from a natural plant. Upon using the method, since only the use of an extract derived from a natural plant provides a pale color tone, a mordanting process using metal ions and the like, that is, a deep-color applying process, is often carried out.

The advantages of the coloring method using plant dyes are that since the extract is a material of natural origin, it is possible to provide an ecological-friendly method, and that since natural products are used, even subtle differences in color tones of the same type are available. In contrast, from the viewpoint of industrial products, the disadvantages of the coloring method using plant dyes include poor color fastness to light, deviations in quality due to the use of a natural product, mottled appearance and difficulty in color reproducibility.

In the field of hair dyes such as white-hair dyes, Patent Document 1 discloses that a pre-treatment agent (reduction agent), polyphenols, a solution of water-soluble salt of iron or copper and an oxidizer (hydrogen peroxide) are used to dye hair black. However, the dyeing is aimed at dyeing human hair and there is no description on coloring cellulose fiber in Patent Document 1, being different in technical field of the present invention which relates to coloring of cellulose fiber.

A coloring method without using a dye was described in Patent Document 2, but the method is associated with a protein fiber inherently containing tryptophan, and there is no description on coloring cellulose fiber in Patent Document 2, being different in technical field of the present invention which relates to coloring of cellulose fiber.

Blue- or black colored fibers were produced in the reaction of andiron ion and tannic acid in Patent Document 3, but the method is also different in coloring method from the present invention, and no description on the physical properties (e.g., color fastness) of the colored fibers were provided therein.

Patent Document 1: Japanese Patent Publication No. 58-45401

Patent Document 2: Japanese Patent Laid-Open Publication No. 2001-055672

Patent Document 3: Japanese Patent Laid-Open Publication No. 2000-143683

DISCLOSURE OF THE INVENTION

Problems to be Solved by the Invention

An object of the present invention, which was made under the circumstances above, is to provide a method for producing a colored cellulose fiber superior in fastness to light without use of a dye and a colored cellulose fiber produced by the method.

In the method according to the present invention, a cellulose fiber is colored through a step (1) of introducing a carboxylic group or a sulfonic acid group into a cellulose fiber, and a step (2) of treating the cellulose fiber having the carboxylic group or the sulfonic acid group introduced with an aromatic derivative having one or more hydroxyl groups and a metal salt simultaneously or separately.

The cellulose fiber for use in the present invention is not particularly limited, and examples thereof include natural celluloses such as cotton and hemp, regenerated celluloses such as viscose rayon, cuprammonium rayon, and polynosic; purified celluloses such as Tencel; and the like. Cellulose fibers to be processed include those in the forms of mixed spun yarn, mixed twisted yarn, union cloth, and mixed knit of a cellulose fiber and a synthetic fiber (e.g., polyester, polyamide, or the like), of cellulose fibers, or of a cellulose fiber and an animal fiber (e.g., wool, silk, or the like) are also included. The cellulose fiber may be in any form: cotton, string, woven fabric, knit fabric, non-woven fabric, or fiber product.

Carboxylic or sulfonic acid groups are introduced into the cellulose fiber by allowing a substance having a carboxylic group or a sulfonic acid group in the molecule to react with the cellulose fiber or by immobilizing the substance in a binder.

Examples of the substances having a carboxyl group in the molecule include polycarboxylic acids, amino acids such as glutamic acid and aspartic acid, acrylic monomers such as acrylic acid and methacrylic acid, acrylic polymers such as a copolymer of acrylic acid or methacrylic acid with a esterified derivative thereof, various proteins such as keratin and casein; and the like. Preferable are polycarboxylic acids.

The polycarboxylic acids are organic compounds having two or more carboxyl groups in one molecule. Examples of the polycarboxylic acids include various straight-chain aliphatic polycarboxylic acids, branched-chain aliphatic polycarboxylic acids, alicyclic polycarboxylic acids, aromatic polycarboxylic acids, and the like. The polycarboxylic acid may have additionally a hydroxyl group, a halogen atom, a carbonyl group, a carbon-carbon double bond, or the like, and may also be an amino acid. The polycarboxylic acid may be soluble, insoluble or scarcely soluble in water, but a water-soluble polycarboxylic acid is preferable from the points of reactivity and workability.

Typical examples of the polycarboxylic acids include straight-chain aliphatic polycarboxylic acids such as oxalic acid, malonic acid, succinic acid, glutalic acid, adipic acid, suberic acid, azelaic acid, and sebacic acid; branched aliphatic polycarboxylic acids of these acids; unsaturated dibasic acids such as maleic acid and fumaric acid; alicyclic dibasic acids such as hexahydrophthalic acid, hexahydroisophthalic acid, hexahydroterephthalic acid, tetrahydrophthalic acid, and nadic acid; tribasic acids such as tricarballylic acid, aconitic acid, and methylcyclohexenetricarboxylic acid; tetrabasic acids such as butanetetracarboxylic acid, cyclopentanetetracarboxylic acid, tetrahydrofurantetracarboxylic acid, and the ene adduct of methyltetrahydrophthalic acid with maleic acid; hydroxy fatty acids such as malic acid, tartaric acid, and citric acid; aromatic polycarboxylic acids such as o-, m- and p-phthalic acids, trimellitic acid, pyromellitic acid, biphenyltetracarboxylic acid, benzophenonetetracarboxylic acid, and diphenylsulfonetetracarboxylic acid; and the like. Among them, preferable polycarboxylic acids are citric acid, butanetetracarboxylic acid, malic acid, succinic acid, and tartaric acid; and particularly preferable are citric acid, butanetetracarboxylic acid, and malic acid.

A part of the carboxyl groups in the polycarboxylic acids exemplified above may be in the form of salt. That a part of the carboxyl groups may form salts means that as far as the polycarboxylic acid molecule can bind to the cellulose fiber via at least one ester bond by the adhesion curing treatment described below, a part of the carboxyl groups may form salts.

The polycarboxylic acid salt is preferably an alkali metal (e.g., sodium, potassium, or the like) salt, an alkali-earth metal (e.g., magnesium, calcium, barium, or the like) salt, or the like; and particularly preferable is an alkali metal for improvement in water solubility of the polycarboxylic acid. Alternatively, ammonium salts and lower amine salts are also favorable.

Examples of the substances having a sulfonic acid group in the molecule include various water-soluble polymers including acrylic polymers such as ATBS-HEA copolymers (acrylamide-t-butylsufonate/2-hydroxyethyl acrylate), ATBS-HEMA copolymers (acrylamide-t-butyl sufonate-/2-hydroxyethyl methacrylate), and the like.

In order to make a substance having a carboxyl group in the molecule react with the cellulose fiber, a method for adhesion-curing of the substance having a carboxyl group in the molecule to the cellulose fiber is preferable.

The "adhesion curing" means a treatment in which a cellulose fiber is immersed in a solution containing a substance having two or more carboxyl groups in the molecule (hereinafter, referred to as "acid-treating solution") and the substance having a carboxyl group is adhered to the cellulose fiber, and then the cellulose fiber is dried and heated to allow at least one carboxyl group in the molecule to bind to the cellulose fiber via an ester bond. Hereinafter, the adhesion curing will be described, taking a polycarboxylic acid as an example. When a substance other than a polycarboxylic acid is used, the same curing treatment according to a polycarboxylic acid may be used.

The acid-treating solution used is preferably an aqueous solution containing water as the solvent from the viewpoints of safety and convenience in handling, but if the polycarboxylic acid is liquid at room temperature, the undiluted solution of the polycarboxylic acid may be used as it is.

It is preferable to adhere the polycarboxylic acid to the cellulose fiber at an amount of 0.1 to 30 wt %, preferably 0.5 to 15 wt %. The adhesion amount is an amount of the polycarboxylic acid adhered to the cellulose fiber. When a polycarboxylic acid solution is used as an acid-treating solution, polycarboxylic acid contained in the polycarboxylic acid solution with which the cellulose fiber is impregnated is in the range above. A smaller adhesion amount may result in insufficient coloring. A larger adhesion amount may lead to such problems as hardening of the feel and texture of fabrics, decoloration or discoloration during processing, loss of strength, and the like. The polycarboxylic acids may be used in combination of two or more, and in such a case, the total amount of the acids adhered is in the range above. The amount of the polycarboxylic acid adhered to cellulose fiber is a value calculated by multiplying a polycarboxylic acid concentration in the acid-treating solution (wt %) by the squeeze rate (%).

The cellulose fiber may be immersed in any one of the immersion methods known in the art, for example, a pad method, a spraying method, a coating method, or the like. The concentration of the polycarboxylic acid in the acid-treating solution or the amount of the acid-treating solution to the cellulose fiber is not particularly limited, when the amount of the polycarboxylic acid falls in the range described above with respect to the cellulose fiber. In particular, the concentration of polycarboxylic acid in the acid-treating solution is preferably 0.1 to 50 wt %, particularly 0.5 to 20 wt %, because an excessively dilute solution may lead to insufficient contact (adhesion) of the cellulose fiber to the polycarboxylic acid, while a concentrated solution to difficulty of uniform adhesion.

Various additives such as softener, pH adjuster, functional additives (such as antibacterial agent and deodorant), and texture adjusters (such as urethane resin, acrylic resin, and ethylene/vinyl acetate resin) may be added to the acid-treating solution as needed. These chemicals are preferably added in the range that does not impair the advantageous coloring effects of the present invention.

Examples of the softeners include silicone softeners, polyethylene softeners, aliphatic amide-softeners, and the like.

The pH of the acid-treating solution is arbitrary when it is in the acidic side, and normally, the pH of the acid-treating solution is in the acidic side without any adjustment. However, an extremely lower pH, for example, less than 1, is not favorable, because the solution may lead to hydrolysis of cellulose and consequently to loss of fiber strength. The pH adjuster may be used in such a case for raising the pH of the acid-treating solution into the range of approximately 1 to 7. Examples of the pH adjusters include hydroxides, carbonate salts, bicarbonate salts, monocarboxylate salts such as formate salt and acetate salt, polycarboxylate salts, phosphate salts, and borate salts of alkali metals; ammonia, secondary amines, tertiary amines, quaternary ammonium salt hydroxides, and the like. Typical examples thereof include sodium hydroxide, sodium bicarbonate, sodium carbonate, sodium borate, sodium metaborate, sodium borohydride, sodium silicate, sodium metasilicate, sodium phosphate, sodium metaphosphate, sodium polyphosphate, sodium pyrophosphate, sodium phosphite, sodium hypophosphite, sodium sulfate, sodium sulfite, sodium thiosulfate, sodium benzenesulfonate, sodium toluenesulfonate, sodium isethionate, sodium formate, sodium acetate, sodium hydroxyacetate, sodium malate, sodium tartrate, sodium citrate, sodium lactate, and the like. In addition to the sodium salts above, potassium salts, ammonium salts, salts of a volatile lower amine such as methyl amine, dimethylamine, trimethylamine, or triethylamine may also be used; and these salts may be used alone or in combination of two or more.

After the polycarboxylic acid is adhered to the cellulose fiber, a curing treatment is carried out, so that the hydroxyl groups of the cellulose fiber react with the carboxyl group of the polycarboxylic acid adhered to the fiber to form ester bonds.

A drying process may be included before the curing process for easier conveyance of the fiber. The drying condition in the drying process is not particularly limited, but normally at 50 to 150° C. for 10 seconds to 20 minutes. Any one of known drying methods, for example by using a heat cylinder, tenter or the like may be used.

The curing treatment is normally performed by heating at 130 to 180° C. for 10 seconds to 20 minutes. Any one of known methods, for example by using a baking machine, far-infrared ray or the like may be used as the curing method.

When an acrylic monomer is used, instead of the adhesion curing method above, a carboxylic group or a sulfonic acid group may be introduced into the cellulose fiber by immersing the fiber in a solution containing the substance and irradiating the impregnated fiber with electron beam, gamma ray, or the like or by irradiating the fiber with electron beam, gamma ray, or the like and then immersing it in a solution containing the substance, and then causing graft polymerization of the impregnated cellulose fiber under heat.

If performed by immobilization with a binder, a carboxylic group or a sulfonic acid group can be introduced into a cellulose fiber by using urethane resins, glyoxal resins, acrylic resins or other resin as a binder, immersing the fiber in a mixed solution of the binder and a substance having a carboxylic group or a sulfonic acid group, and then drying and curing the impregnated fabric.

The cellulose fiber having a carboxylic group or a sulfonic acid group introduced (hereinafter, referred to simply as "acid-modified cellulose fiber") is then treated with an aromatic derivative having one or more hydroxyl groups and a metal salt.

Examples of the aromatic derivatives having one or more hydroxyl groups include hydroxybenzoic acid, hydroxybenzaldehyde, dihydroxybenzene, dihydroxybenzoic acid, dihydroxybenzaldehyde, trihydroxybenzene, trihydroxybenzoic acid, trihydroxybenzaldehyde, tannic acid, and the like, and the esters thereof. These substances may be the salts thereof, such as sodium and potassium. These substances may be used alone or in combination of two or more.

Heavy metal salts, for example with iron, copper, aluminum, and nickel, may be used as a metal salt. Examples of the metal salts include inorganic salts such as nitrate, sulfate, and chloride, and organic salts such as acetate and citrate salt. These salts may be used alone or in combination of two or more.

The treatment with an aromatic derivative having one or more hydroxyl groups (hereinafter, referred to simply as "hydroxyl group treatment") and the treatment with a metal salt (hereinafter, referred to simply as "metal salt treatment") may be performed simultaneously by mixing these substances (hereinafter, referred to as "simultaneous metal salt/hydroxyl group treatment") or separately. If performed separately, the metal salt treatment may be performed before the hydroxyl group treatment, or the hydroxyl group treatment may be performed before the metal salt treatment. The treatment is preferably conducted in the former way. After the metal salt or hydroxyl group treatment, the fiber is taken out from the aqueous solution, washed with water, and as needed dehydrated and dried, and fed continuously into the next step.

The metal salt treatment may be performed by immersing the acid-modified cellulose fiber in an aqueous solution containing a metal salt at a concentration approximately of 0.01 to 15 wt %, preferably 0.5 to 5 wt %. The immersion may be performed at a temperature of 10 to 100° C., preferably 20 to 35° C., for approximately 2 seconds to 100 minutes. In addition to the immersion method, the treatment can be performed by spraying an aqueous metal salt solution on the acid-modified cellulose fiber and thus impregnating the cellulose fiber with the aqueous solution.

The hydroxyl group treatment may be performed by immersing the acid-modified cellulose fiber in an aqueous solution containing an aromatic derivative having one or more hydroxyl groups at a concentration approximately of 0.01 to 15 wt %, preferably 0.1 to 5 wt %. The immersion may be performed at a temperature of 10 to 100° C., preferably 20 to 70° C. for approximately 2 seconds to 100 minutes. In addition to the immersion method, the hydroxyl group treatment may be performed by spraying an aqueous solution containing an aromatic derivative having one or more hydroxyl groups on the acid-modified cellulose fiber and thus impregnating the cellulose fiber with the aqueous solution. The aromatic-derivative having one or more hydroxyl groups and the metal salt form a complex, giving a coloring substance. The coloring substance binds to the acid-modified cellulose fiber tightly, giving a fast colored fiber.

Simultaneous metal salt/hydroxyl group treatment may be performed in a manner similar to the separate metal salt and hydroxyl group treatments, by using an aqueous solution containing the metal salt and the aromatic derivative having one or more hydroxyl groups respectively at concentrations described above.

After the metal salt and hydroxyl group treatments, the fiber is washed with water and dried.

The colored cellulose fiber according to the present invention may be dyed and produced in any one of known devices such as continuous dyeing machines, jet dyeing machines, and cheese dyeing machines.

The cellulose fiber is colored without use of a dye by the above treatment. The colored cellulose fiber is superior in fastness to light. The colorations include dark brown, bordeaux, brown, beige, and others. A desirable color can be developed by selecting an aromatic derivative having one or more hydroxyl groups and a metal salt and adjusting the conditions properly. It is possible to raise the color density by carrying out the hydroxyl group or metal salt treatment at higher temperature and higher concentration, or alternatively, to decrease the color density at a lower temperature and a lower concentration.

The method for coloring a cellulose fiber described above also provides a colored cellulose fiber prepared thereby, and the present invention provides a method for producing a colored cellulose fiber including the following steps (1) and (2) and a colored cellulose fiber manufactured by the production method:

a step (1) of introducing a carboxylic group or a sulfonic acid group into a cellulose fiber, and a step (2) of treating the cellulose fiber having the carboxylic group or the sulfonic acid group introduced with an aromatic derivative having one or more hydroxyl groups and a metal salt simultaneously or separately.

EFFECTS OF THE INVENTION

Reduction in environmental load, due to use of no dye

Development of deep color

Possibility of continuous treatment.

Superiority in reproducibility and fastness to light

EXAMPLES

Example 1

A 100%-cotton broad fabric (yarn number: warp: 50, weft: 40; and fabric density: warp: 144, weft: 72 yarns/inch, scouring and bleaching processing→mercerization) was immersed in a treating solution (10 wt % citric acid, 2 wt % sodium carbonate), squeezed with a mangle (squeeze rate: 60%), dried (130° C.×2 min), cured (160° C.×2 min), and washed with water, to give an acid-modified cellulose fabric having carboxyl groups introduced therein. Then, the acid-modified cellulose fabric was immersed in an aqueous 2 wt % iron chloride (III) solution at room temperature (30° C.) for 5 minutes (metal salt treatment), and then in an aqueous 0.5 wt % tannic acid at room temperature (30° C.) for 5 minutes (hydroxyl group treatment). Subsequently, the fabric was washed with water and dried (130° C.×2 min), to give a colored fabric.

Example 2

A colored fabric was prepared in a manner similar to example 1, except that the fabric in Example 1 was replaced with a broad T/C blended fabric (polyester 65%/cotton 35%, yarn number: warp: 50, weft: 40, fabric density: warp: 144, weft: 72 yarns/inch, scouring and bleaching→mercerization).

Example 3

A colored fabric was prepared in a manner similar to example 1, except that 2,4-dihydroxybenzaldehyde was used as an aromatic derivative having one or more hydroxyl groups.

Example 4

A colored fabric was prepared in a manner similar to example 1, except that 3,4-dihydroxybenzoic acid was used as an aromatic derivative having one or more hydroxyl groups.

Example 5

A colored fabric was prepared in a manner similar to example 1, except that copper chloride was used as a metal salt.

Example 6

A colored fabric was prepared in a manner similar to example 1, except that the functional group to be introduced was changed from a carboxyl group to a sulfonic acid group (treating solution→10 wt % ATBS-HEA copolymer (acrylamide-t-butyl sufonate/2-hydroxyethyl acrylate)).

Comparative Example 1

A colored fabric was prepared in a manner similar to example 1, except that no carboxyl group was introduced.

Comparative Example 2

A colored fabric was prepared in a manner similar to example 1, except that no metal salt treatment was performed.

Comparative Example 3

A colored fabric was prepared in a manner similar to example 1, except that the fabric was treated with no aromatic derivative having one or more hydroxyl groups.

Evaluation

The Lab value of each of the fabrics obtained in examples and comparative examples was determined by using COLOR READER CR10 (manufactured by Konica Minolta Holdings, Inc.). The Lab value is an indicator of color density and hue of color.

The hue was examined by visual observation.

The color development was examined visually and ranked as follows:

O: Favorable color development

×: Improper color development

The fastness to light was determined according to the method of JIS L0842.

Evaluation results are summarized in table 1.

| | Lab value | | | | | Fastness |
|---|---|---|---|---|---|---|
| | L value | a value | b value | Hue | Color development | to light (class) |
| Example 1 | 27.8 | 3.9 | 6.9 | dark brown | ○ | 4 |
| Example 2 | 31.5 | 4.0 | 5.1 | dark brown | ○ | 4 |
| Example 3 | 58.5 | 17.5 | 40.2 | bordeaux | ○ | 4 |
| Example 4 | 35.1 | 5.0 | 6.2 | brown | ○ | 4 |
| Example 5 | 57.7 | 2.2 | 15.9 | beige | ○ | 4 |
| Example 6 | 42.5 | 4.5 | 6.0 | brown | ○ | 4 |
| Comparative Example 1 | 89.8 | 2.8 | 6.0 | off white | x | less than 3 |
| Comparative Example 2 | 88.7 | 3.0 | 4.0 | off white | x | less than 3 |
| Comparative Example 3 | 80.0 | 6.1 | 26.4 | pale yellow | x | less than 3 |

The invention claimed is:

1. A method for coloring a cellulose fiber, comprising:

a step (1) of introducing a carboxylic group into cellulose fiber; and a step (2) of treating the cellulose fiber having the carboxylic group introduced with an aromatic derivative having one or more hydroxyl groups selected from dihydroxybenzoic acid, dihydroxybenzaldehyde, trihydroxybenzoic acid or trihydroxybenzaldehyde and a metal salt, wherein the metal salt is an iron salt, simultaneously or separately;

wherein the cellulose fiber is colored without the use of a dye.

2. The method for coloring a cellulose fiber according to claim 1, wherein carboxylic groups are introduced into the cellulose fiber by an adhesion curing treatment with a polycarboxylic acid.

3. The method for coloring a cellulose fiber according to claim 1, wherein a carboxylic group is introduced into the cellulose fiber by irradiating the fiber with an electron beam or gamma ray.

4. The method for coloring a cellulose fiber according to claim 1, wherein a carboxylic group is introduced into the cellulose fiber by immobilization with urethane resins, glyoxal resins or acrylic resins as a binder.

5. The method for coloring a cellulose fiber according to claim 1, wherein treatment with a metal salt is performed by immersion or spraying.

6. The method for coloring a cellulose fiber according to claim 1, wherein treatment with an aromatic derivative having one or more hydroxyl groups is performed by immersion or spraying.

7. The method for coloring a cellulose fiber according to claim 2, wherein the adhesion amount of the polycarboxylic acid is from 0.1 to 30 wt %.

8. A method for producing a colored cellulose fiber, comprising:

a step (1) of introducing a carboxylic group into a cellulose fiber; and a step (2) of treating the cellulose fiber having the carboxylic group introduced with an aromatic derivative having one or more hydroxyl groups selected from dihydroxybenzoic acid, dihydroxybenzaldehyde, trihydroxybenzoic acid or trihydroxybenzaldehyde and a metal salt, wherein the metal salt is an iron salt, simultaneously or separately;

wherein the cellulose fiber is colored without the use of a dye.

9. The method for producing a colored cellulose fiber according to claim 8, wherein carboxylic groups are introduced into the cellulose fiber by an adhesion curing treatment with a polycarboxylic acid.

10. The method for producing a colored cellulose fiber according to claim 8, wherein a carboxylic group is introduced into the cellulose fiber by irradiating the fiber with an electron beam or gamma ray.

11. The method for producing a colored cellulose fiber according to claim 8, wherein a carboxylic group is introduced into the cellulose fiber by immobilization with urethane resins, glyoxal resins or acrylic resins as a binder.

12. The method for producing a colored cellulose fiber according to claim 8, wherein treatment with a metal salt is performed by immersion or spraying.

13. The method for producing a colored cellulose fiber according to claim 8, wherein treatment with an aromatic derivative having one or more hydroxyl groups is performed by immersion or spraying.

* * * * *